US008602601B2

(12) United States Patent
Khazi et al.

(10) Patent No.: US 8,602,601 B2
(45) Date of Patent: Dec. 10, 2013

(54) LED DOWNLIGHT RETAINING RING

(75) Inventors: Mohamed Aslam Khazi, Bloomfield Hills, MI (US); Kenneth Czech, Dartmouth, MA (US); Peter Franck, Seekonk, MA (US); Alejandro Mier-Langner, Providence, RI (US)

(73) Assignee: Koninklijke Philips N.V., Eindhoven (NL)

( * ) Notice: Subject to any disclaimer, the term of this patent is extended or adjusted under 35 U.S.C. 154(b) by 607 days.

(21) Appl. No.: 12/703,334

(22) Filed: Feb. 10, 2010

(65) Prior Publication Data

US 2010/0259919 A1 Oct. 14, 2010

Related U.S. Application Data

(60) Provisional application No. 61/151,774, filed on Feb. 11, 2009.

(51) Int. Cl.
*F21V 7/00* (2006.01)

(52) U.S. Cl.
USPC ..... 362/297; 362/249.02; 362/311.02; 362/364; 362/800

(58) Field of Classification Search
USPC ..... 362/249.02, 294, 296.01, 297, 362/299–300, 311.02, 364, 800
See application file for complete search history.

(56) References Cited

U.S. PATENT DOCUMENTS

| | | | | |
|---|---|---|---|---|
| 8,070,328 | B1 * | 12/2011 | Knoble et al. | 362/311.02 |
| 8,142,057 | B2 * | 3/2012 | Roos et al. | 362/364 |
| 2005/0168986 | A1 | 8/2005 | Wegner | |
| 2008/0112170 | A1 * | 5/2008 | Trott et al. | 362/311 |
| 2008/0165535 | A1 | 7/2008 | Mazzochette | |

FOREIGN PATENT DOCUMENTS

| | | | |
|---|---|---|---|
| JP | 2007035366 | A | 2/2007 |
| WO | 2006105346 | A1 | 10/2006 |
| WO | 2008067477 | A1 | 6/2008 |

* cited by examiner

*Primary Examiner* — Jason Moon Han

(57) ABSTRACT

An LED downlight comprises a primary reflector having an upper end and an open lower end, an LED printed circuit board assembly disposed in the upper end of the reflector, an optical assembly positioned beneath the LED printed circuit board assembly, a secondary reflective ring positioned beneath the LED printed circuit board assembly and within the primary reflector housing, the secondary reflector ring supporting the optical assembly and improving light distribution.

20 Claims, 10 Drawing Sheets

LED DOWNLIGHT RETAINING RING

CROSS-REFERENCE TO RELATED APPLICATIONS

The present non-provisional application claims priority to U.S. Provisional Application Ser. No. 61/151,774, filed Feb. 11, 2009.

TECHNICAL FIELD

The present invention first embodiment pertains to a downlight luminaire. More specifically, the first embodiment pertains to a downlight luminaire having a first heat dissipation subassembly and a reflector which is in direct thermal communication with a LED printed circuit board assembly so as to dissipate heat through two structures and provide higher efficiency of operation.

Additionally, a second embodiment pertains to a downlight luminaire. More specifically, the second embodiment pertains to a downlight luminaire having a retaining ring positioned within the luminaire reflector for supporting an optical assembly and reflecting light to a center area beneath the downlight in order to provide higher illumination directly beneath the luminaire.

BACKGROUND

Recessed downlight luminaires are extremely popular due to their unobstructive, hidden nature within a ceiling and the versatility provided by the various types of downlights available. Downlights may be used to provide wall wash, normal downlight or highlight a specific area.

As the popularity of these luminaires has grown, improvements have been continually made to improve the operating efficiency and lighting characteristics. For example, downlights have been developed to operate with compact fluorescent lamps (CFLs). Even more efficient than CFLs, it would be desirable to develop downlights to operate specifically with light emitting diodes (LEDs). However, when LEDs are positioned in deep round reflectors, there is a propensity to have a dark area in the center of a light dispersion graph. As shown in FIG. 1, the center area beneath the downlight indicates a sharp decrease in illumination at the center of the light distribution pattern. It would be desirable to redirect some light toward the center of the light distribution pattern to provide more uniform illumination on a work plane.

Another area of desired improvement is with operating efficiency. In general, LEDs have the potential to provide a higher efficiency and longer life than other light sources. LEDs have a higher operating efficiency in part due to cooler operating temperatures. Moreover, LEDs do not burn out like incandescent bulbs, but instead dim over the course of their life. When LEDs operate at cooler temperatures, they operate more efficiently, meaning higher light output for given input energy. Additionally, with more efficient operation at cooler temperatures, the LEDs have longer life. As temperatures increase however, the efficiency decreases and the life is reduced.

Downlights are typically positioned in a plenum or similar volume above a ceiling. Since this plenum area is typically enclosed, the heat from the downlight has a tendency to build up and over a period of time and the temperature is higher than the temperature below, in the illuminated area. Since the illuminated area below the light is cooler than the volume above, it would be desirable, from an operating efficiency perspective, to transfer some heat to this area beneath the luminaire in order improve LED performance and life.

Given the foregoing deficiencies, it would be desirable to overcome the above and other deficiencies.

SUMMARY

An LED downlight comprises a primary reflector having an upper end and an open lower end, an LED printed circuit board assembly disposed in the upper end of the reflector, an optical assembly positioned beneath the LED printed circuit board assembly, a secondary reflective ring positioned beneath the LED printed circuit board assembly and within the primary reflector housing, the secondary reflector ring supporting the optical assembly and improving light distribution. The LED downlight wherein the secondary reflector ring has an inner beveled surface. The LED downlight wherein the inner beveled surface directs light downwardly centrally beneath the downlight. The LED downlight wherein the inner beveled surface is disposed at angle of between about 35 and 65 degrees. The LED downlight wherein the LED downlight having a plurality of blue LEDs. The LED downlight wherein the optical assembly has a phosphor system on an inner surface closest to the LED printed circuit board assembly.

An LED downlight comprises an LED array disposed on a printed circuit board, a mixing chamber disposed within a primary reflector, the LED array positioned near an upper end of the primary reflector, a retaining ring having a reflective inner surface positioned with the primary reflector, an optical assembly disposed within the retaining ring, the mixing chamber capturing the optical assembly within the retaining ring, the retaining ring inner surface being beveled and distributing a light pattern downward and centrally beneath the downlight. The LED downlight wherein the beveled inner surface disposed at an angle of between about 35 and 65 degrees. The LED downlight wherein the beveled inner surface has a length of about 0.1 inches. The LED downlight wherein the beveled inner surface extends from the lens to the primary reflector. The LED downlight wherein the retaining ring having a lip for seating the lens. The LED downlight wherein the LED array has a plurality of white LEDs. The LED downlight wherein the LED array is connected to a metal core printed circuit board. The LED downlight wherein the retaining ring is formed of aluminum. The LED downlight wherein the retaining ring inner beveled surface is one of specular, diffuse or semi-diffuse.

An LED downlight comprises a primary reflector having an upper end and a lower open end, a LED printed circuit board assembly disposed near the upper end of the primary reflector, a mixing subassembly depending downwardly toward a lens, the mixing subassembly receiving light from the LED printed circuit board assembly, the lens beneath the LED printed circuit board assembly, a retaining ring receiving the lens, the retaining ring disposed within the primary reflector, the retaining ring further comprising an angled inner surface. The LED downlight further comprising a plurality of LED apertures disposed in an upper surface of the mixing subassembly. The LED downlight further comprising the mixing subassembly having a reflective inner surface. The LED downlight wherein the mixing assembly is substantially frusto-conical in shape. The LED downlight further comprising a mixing chamber being seated in the retaining ring. The LED downlight wherein the mixing chamber is fastened to the heat sink.

BRIEF DESCRIPTION OF THE ILLUSTRATIONS

A better understanding of the embodiments of the invention will be had upon reference to the following description in conjunction with the accompanying drawings in which like numerals refer to like parts throughout the several views and wherein.

DETAILED DESCRIPTION

Figure 1:
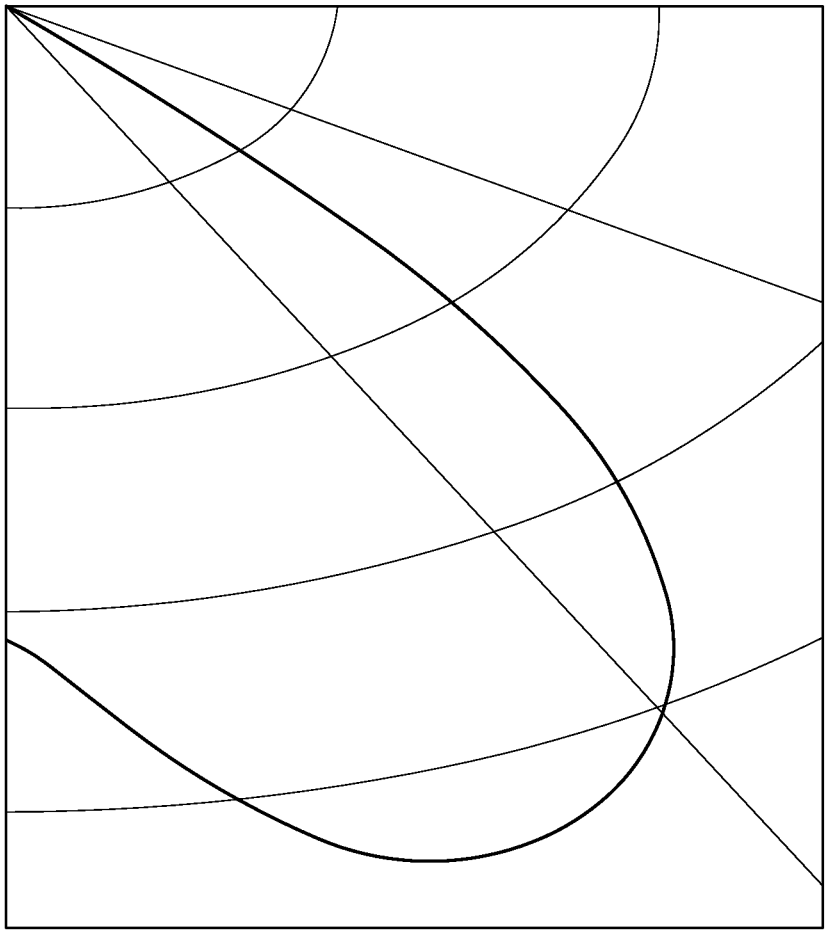
FIG. 1 PRIOR ART
FIG. 1 is a light distribution graph of a prior art downlight indicating lower output beneath the downlight.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 2-10 various embodiments of a light emitting diode (LED) downlight. The LED downlight includes a heat sink at the upper end of the fixture and a thermally conductive reflector beneath the heat sink to provide two modes of heat dissipation. The LED printed circuit board assembly is in direct engagement with at least one of the light reflector and the heat sink in order to transfer heat. The LED downlight also comprises a reflective retaining ring to improve lighting directly beneath the LED downlight as indicated in a light dispersion graph. The retaining ring also provides a seat for an optical assembly in the downlight.

Figure 2:
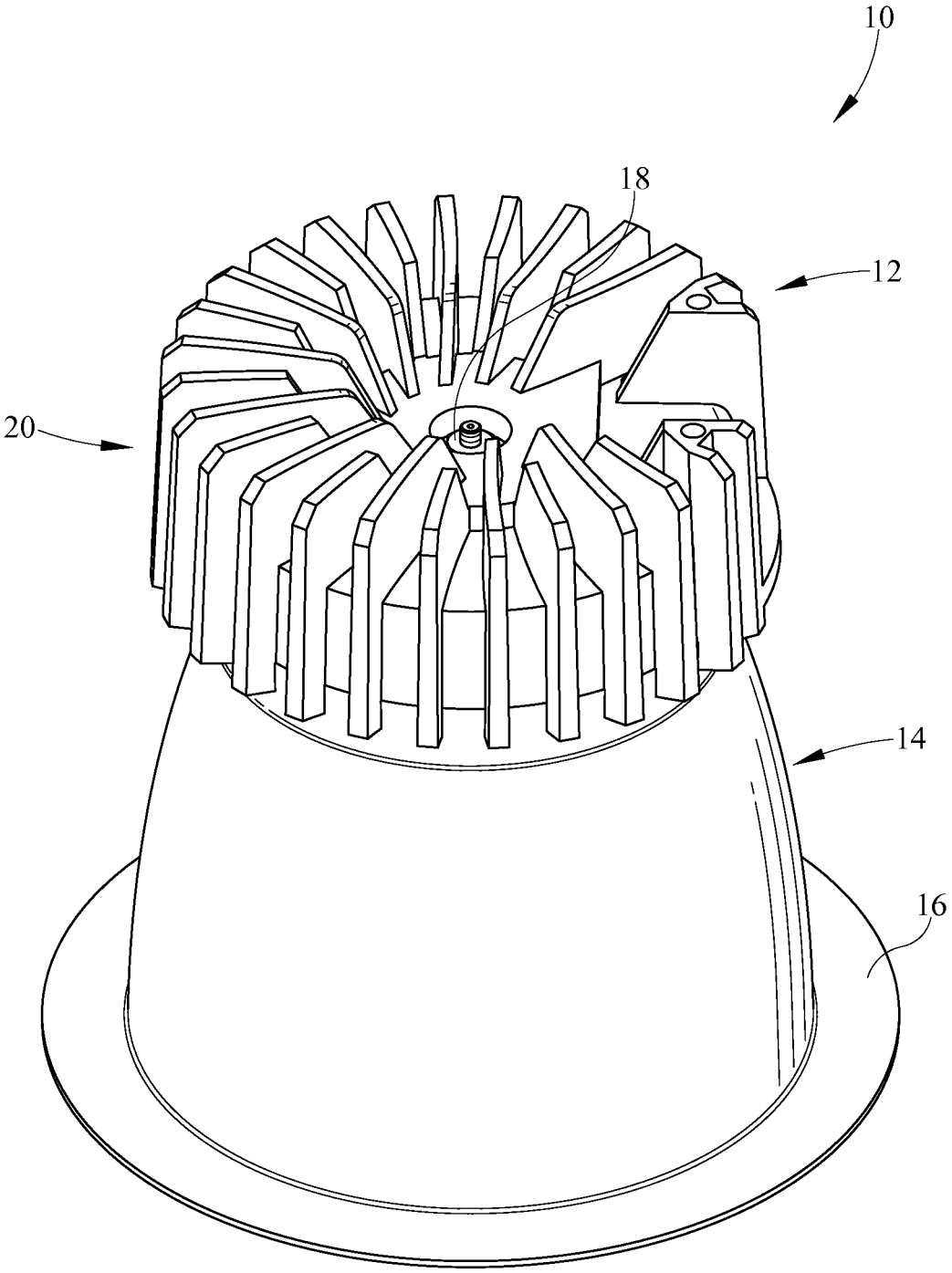
FIG. 2 is a perspective view of an exemplary LED downlight.

Referring initially to FIG. 2, a perspective view of the LED downlight 10 is shown. The light emitting diode (LED) downlight 10 comprises a heat dissipation subassembly 12 and a primary reflector 14. The primary reflector 14 includes curved sidewalls and an upper end where the heat sink 20 is positioned, although alternative shapes may be utilized and such descriptions should not be considered limiting. At a lower edge of the primary reflector 14 is a trim ring or flange 16. In order to position the recessed downlight the LED downlight 10, a ceiling aperture is formed within the ceiling material, such as drywall, plaster, or ceiling panel. Ceiling shall mean any horizontal/angular type plane, including but not limited to over head room ceilings, soffits, or other type structures, capable of supporting the LED downlight 10 device. The ceiling aperture may not exactly match the dimensions of the lowermost edge of the primary reflector 14. Accordingly, the flange 16 extends radially outward and covers the hole in the ceiling to provide a clean, aesthetically pleasing look for the downlight, which will be understood by one skilled in the art. This configuration also places the thermally conductive reflector 14 in thermal communication with the cooler air space below the luminaire 10.

The LED downlight 10 utilizes an upper heat sink structure to dissipate heat as part of the heat dissipation subassembly 12. The device further utilizes the primary reflector 14 as a second heat dissipation means in order to further dissipate heat from the device which increases the efficiently and life of the LEDs utilized within the downlight 10. In the exemplary embodiment, the heat sink 20 and the reflector 14 do not touch one another. This creates the two modes of heat dissipation and inhibits transfer of heat from the heat sink 20 through the reflector 14.

Figure 3:
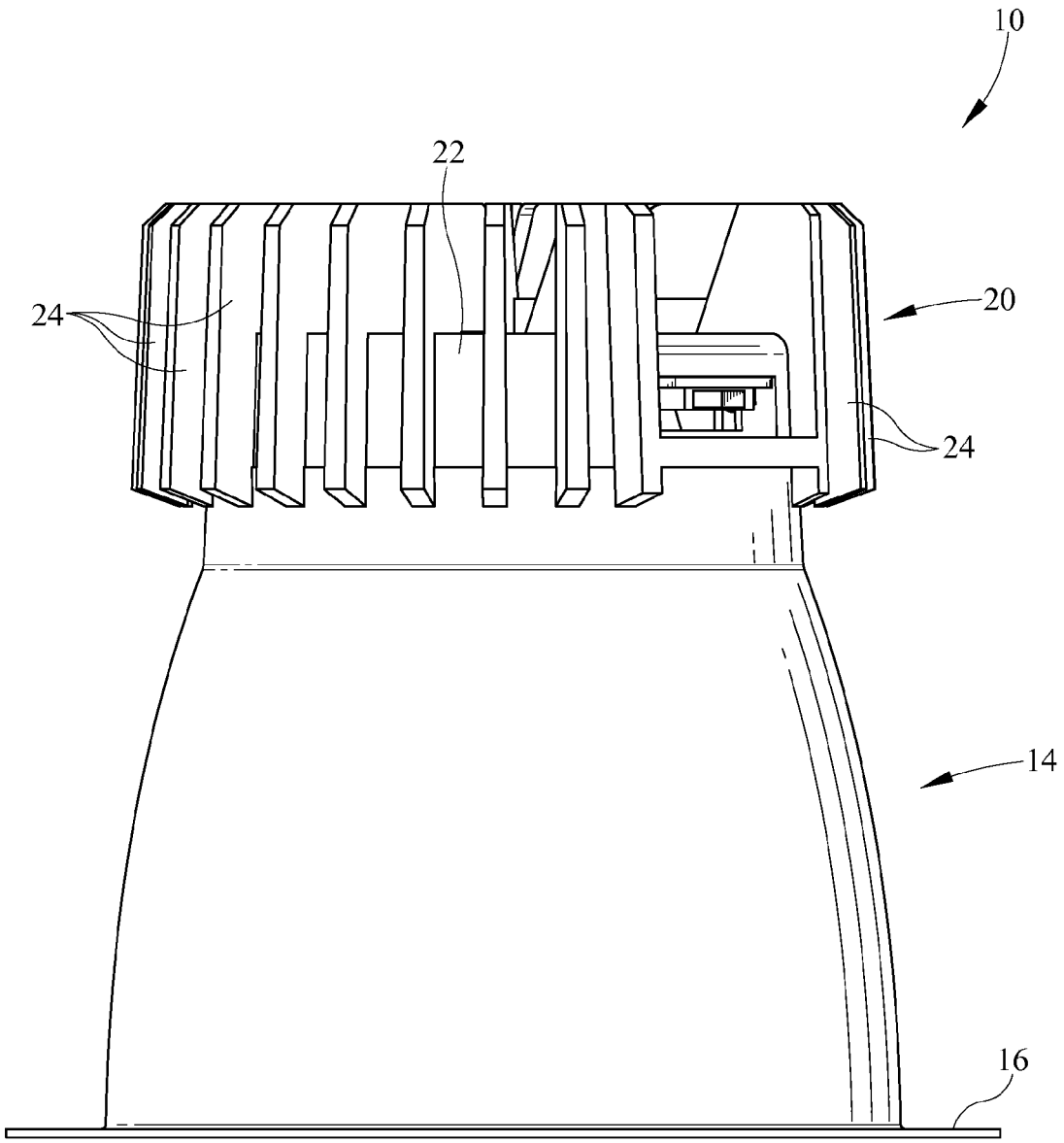
FIG. 3 is a side elevation view of the LED downlight of FIG. 2.

Referring now to FIG. 3, the LED downlight 10 is depicted in a side elevation view. The heat sink subassembly 12 comprises a heat sink or first dissipation means 20 positioned near the upper end of the primary reflector 14. As an alternative, the heat sink 20 could be positioned spaced some distance from the reflector 14. The heat sink 20 generally comprises a cylindrical body 20 surrounding or generally disposed around the upper portion of the primary reflector 14. However, the cylindrical shape should not be considered limiting as various alternative shapes may be utilized, such as pentagonal, octagonal, square or other such geometries. The body 22 receives heat generated by the LEDs within the downlight 10 and transfers the heat through the body 22 to a plurality of fins 24 which dissipate heat to a plenum wherein the downlight 10 is positioned. The heat sink or first heat dissipation means 20 is formed of aluminum material. However, alternative materials with good thermal transfer properties may be utilized within the scope of the present invention, in order to dissipate the heat. For example, cast copper, zinc or injection molded materials having good thermal conductivities may be utilized.

The primary reflector 14 is formed of a spun aluminum material and may be finished in various manners including an anodized diffuse or specular finish, a clear finish, a painted finish or another reflective metalized finish, for example. Since the primary reflector 14 is also used as a secondary heat dissipation means, the reflector 14 is preferably also made up a material having a good thermal conductivity characteristics.

Figure 4:
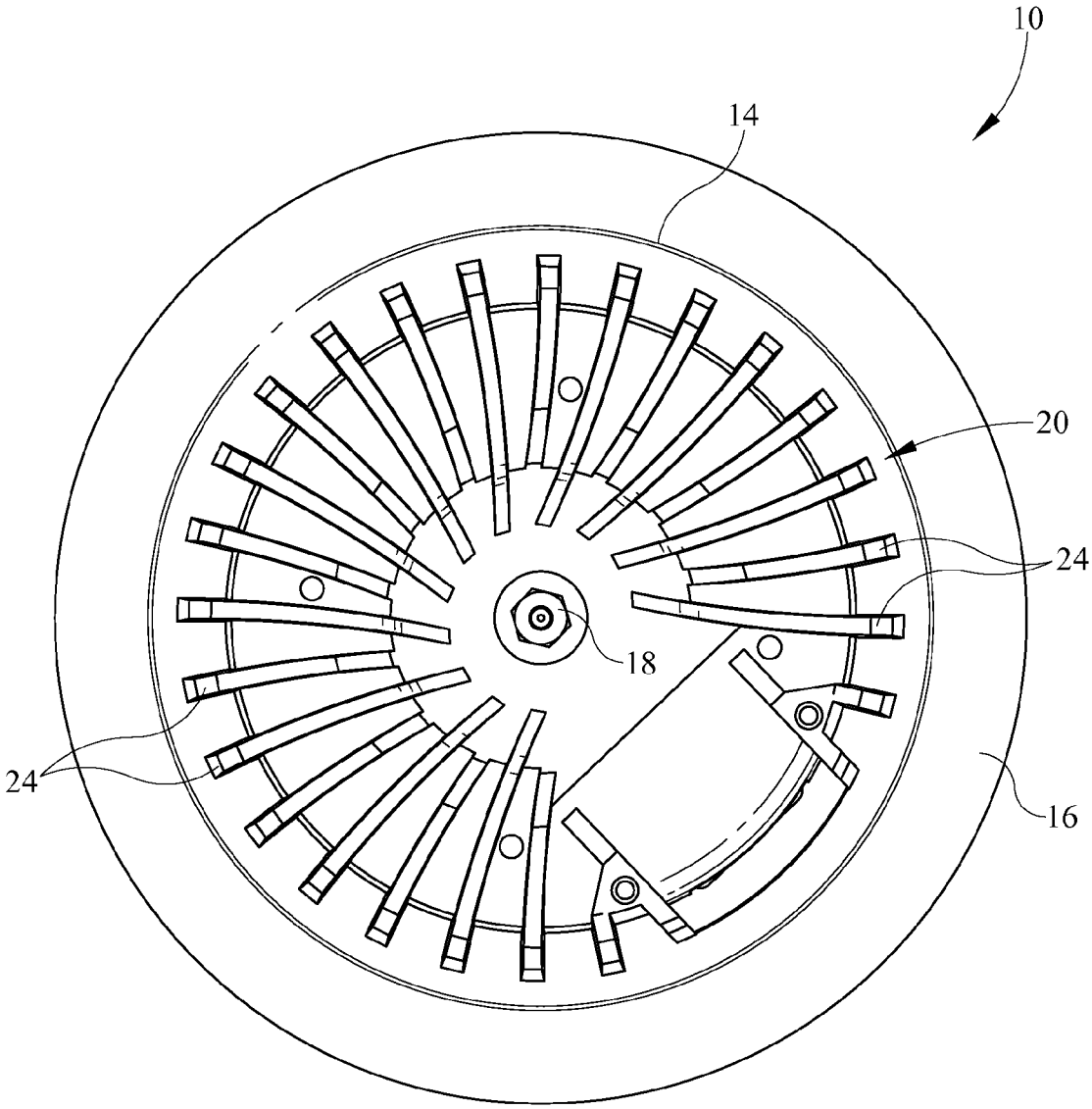
FIG. 4 is a top view of the LED downlight of FIG. 2.

Referring to FIG. 4, a top view of the downlight fixture 10 is depicted. Since the flange 16 and portions of the primary reflector 14 are in thermal communication with the space beneath the ceiling, the primary reflector 14 functions as a secondary heat dissipation means also removing heat from the LEDs by utilizing the relatively cooler air space below. Efficiency studies indicate increased performance of about 8 to about 20 percent. The space beneath the downlight 10 is typically a cooler temperature than the plenum area where the heat sink 20 is positioned. Since the flange 16 and primary reflector 14 are in fluid communication with this cooler area, the reflector 14 removes additional heat from the LED printed circuit board assembly 30 (FIG. 5) to operate more efficiently, ultimately saving money and increasing the life and efficiency of the downlight 10 LEDs.

Referring still to FIG. 4, the heat sink 20 is clearly shown above the primary reflector 14. The plurality of fins 24 extend from the central area body 22 of the heat sink 20 generally radially outward. The fins 24 may have a slight curvature when viewed from above. The curvature increases surface area of the fins 24. Additionally, the curvature has been optimally designed to increase air flow over the fins caused by the convective heat currents. A subassembly nut 18 is also visible from the top view. The subassembly 12 is connected by four screws to the reflector shoulder 15. This configuration sandwiches the LED printed circuit board assembly 30 (FIG. 5) between the heat sink 20 and the reflector 14. This in turn provides proper contact between the board 30, interface 28 (FIG. 5) and the heat sink 20 as well as between the board 30 and the reflector collar 15.

Figure 5:
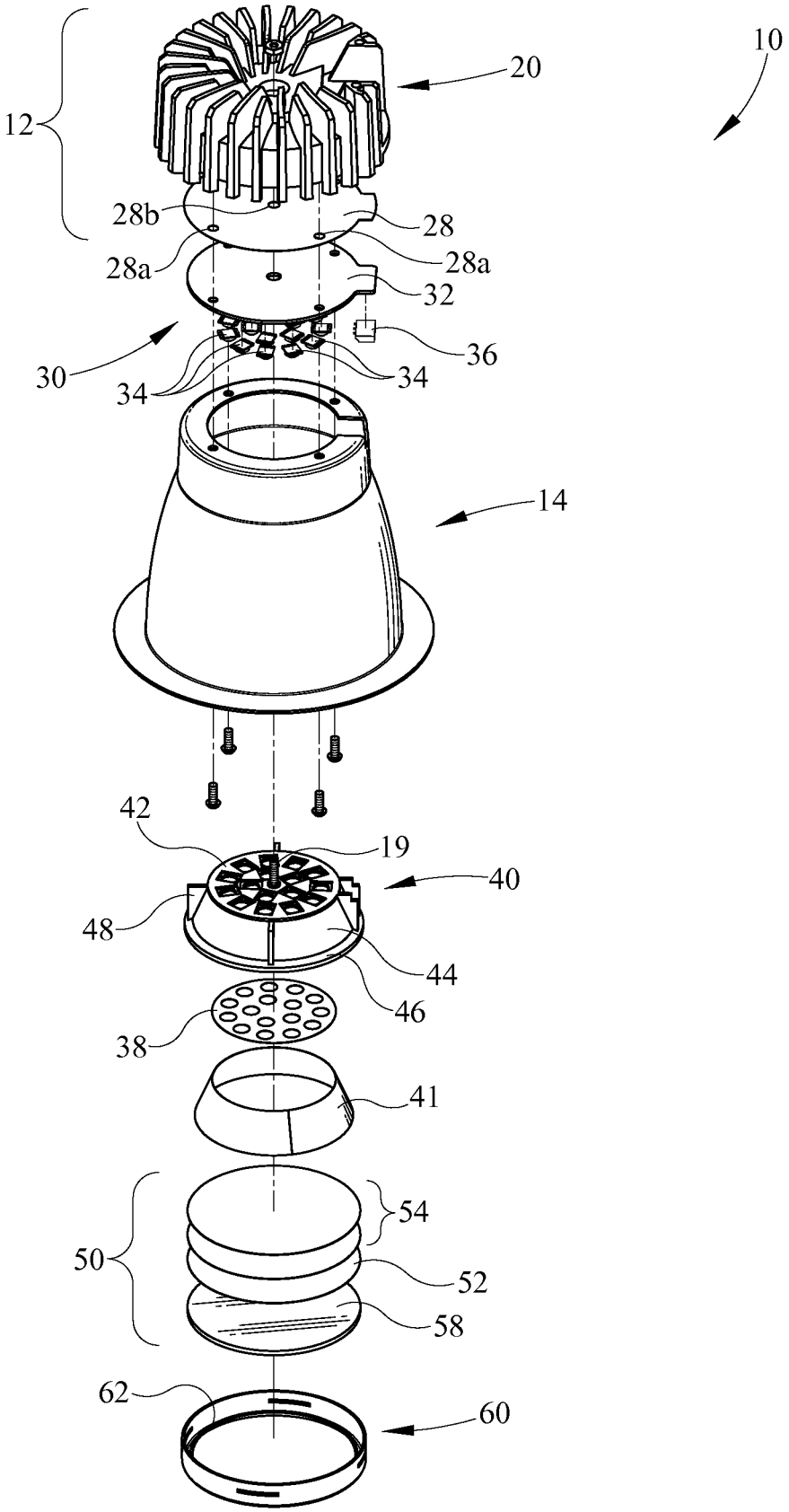
FIG. 5 is an exploded perspective view of the LED downlight of FIG. 2.

Referring now to FIG. 5, an exploded perspective view of the LED downlight 10 is depicted. As previously indicated, the downlight comprises a heat dissipation subassembly 12 having the heat sink 20 and a thermal pad or interface 28. The thermal interface 28 is formed of a thermally conductive material having an upper surface and a lower surface and may be in contact with at least one of the heat sink 20 and the reflector 14. The thermal interface 28 comprises a plurality of apertures 28*a* for connecting the interface 28 to a LED printed circuit board assembly 30. The interface 28 compensates for surface irregularities which otherwise might inhibit optimal thermal transfer. The interface 28 also defines a path for heat transfer from the LED printed circuit board assembly 30 to the heat sink 20. Alternatively, if surface irregularities are removed, the thermal interface 28 could also be removed from the assembly. The apertures 28*a* allow the fasteners to connect the thermal pad to the LED printed circuit board assembly 30. A subassembly fastening aperture 28*b* is also centrally positioned on the thermal pad 28. This allows a fastening connection of a mixing chamber 40 to the heat dissipation subassembly 12. The exemplary thermal interface 28 may be formed of grease, silicone, graphite or any thermally conductive medium. Beneath the thermal pad or inner face 28 is a LED metal core printed circuit board 32. An exemplary model used in the present embodiment may be formed of aluminum metal core board, copper metal core board, or fiberglass reinforced (FR4) board. The printed circuit board 32 is formed of thermal conductive material which moves heat from the LEDs 34 to the heat sink 20 through the interface 28. Also the printed circuit board 32 moves heat through the primary reflector 14 by direct contact between the two parts.

Exploded from the LED metal core printed circuit board 32 are a plurality of LEDs 34 and a power connector 36. The LEDs 34 are available from a variety of manufactures and are electrically connected to the printed circuit board 32. The LEDs 34 may emit any color desired for any given lighting application and may be selected by a lighting designer for example. Additionally, the LED printed circuit board assembly 30 comprises 16 LEDs 34 although this number is merely exemplary and therefore should not be considered limiting.

Beneath the heat dissipation subassembly 12 and the LED printed circuit board assembly 30 is the primary reflector 14. The retaining ring 60, optical assembly 50 and the mixing chamber 40 are positioned up through the lower opening of the primary reflector 40 against the upper shoulder or collar 15 of the reflector 14. The mixing chamber 40 comprises of a fastener 19 extending from a central location which passes through the opening in the primary reflector 14 and upwardly through the LED printed circuit board assembly 30 and the thermal interface 28 and heat sink 20. The fastener 19 is tightened by the subassembly nut 18 so that the mixing chamber 40 and optical assembly 50 are held in position. According to this embodiment, the upper heat dissipation system are held in place by the four screws and the lower optical system are held in position by the fastener 19.

Beneath the primary reflector 14 is a mixing chamber 40. The mixing chamber 40 collects and redirects the light emitted from the various LEDs 34 while also inhibiting visual recognition of any single LED 34. Because each LED may differ slightly in color, the mixing chamber 40 combines the light into a single output color and does so in an efficient manner. The exemplary mixing chamber 40 is a plastic subassembly, although other materials could be used, comprising a reflective material or coating along an inner surface thereof, described further herein. The mixing chamber 40 is generally frusto-conical in shape with an upper surface 42 and a frusto-conical sidewall 44 extending from the top wall 42 down to a lower flange 46. The top wall 42 includes a plurality of apertures which are aligned with the LEDs 34 therein or at least allow light to pass there through. The mixing chamber 40 further comprises a plurality of keying or positioning spacers 48 extending from the sidewall 44 in order to properly position the mixing chamber within the inner surface of the primary reflector 14.

Exploded from the mixing chamber 40 is a reflective material 38. The reflective material 38 may be a film, tape or coating positioned on an upper inner surface of the mixing chamber 40 beneath the LED printed circuit board assembly 30. The reflective film 38 has a plurality of apertures through which the LEDs or light output from the LEDs may pass into the mixing chamber 40.

Also exploded from the mixing chamber 40 is the reflective inner surface material 41. The reflective material may be a 3M polyester film having a marketing name, "Vikuiti". The material 41 is positioned along the inner surface of sidewall 44 so as to reflect light from the inner surface of the mixing chamber 40. In an alternative embodiment, the mixing chamber 40 may be formed of metallic material which may be polished so that the reflective film 41 is not utilized. In further embodiments, the mixing chamber 40 may either be painted or have a treated metallic surface so as to reflect light in a desirable manner.

Beneath the mixing chamber 40 is an optical assembly 50. The optical assembly 50 moves the light source from the LEDs 34 to an effective light source at the lens 58. Additionally, the optical assembly 50, in combination with the mixing chamber 40, helps to output a single mixed light rather than multiple distinct sources from the multiple LEDs. The optical assembly 50 may include a lens 58, a diffuser, and/or a phosphor system 54 or any combination thereof. The diffuser 52 spreads and controls the light output from the down light 10. The diffuser 52 may be one of glass or a polycarbonate and may be smoothly finished or may have a plurality of prismatic structure, grooved or other light controlling implements. Similarly, the lens 58 may be formed of glass, polycarbonate or other such material. On the upper surface of the diffuser 52 may be a phosphor system 54, which may be used to control lighting color. Alternatively, the LED's 32 may be white LEDs so as to eliminate the need for the phosphor system 54.

Figure 10:
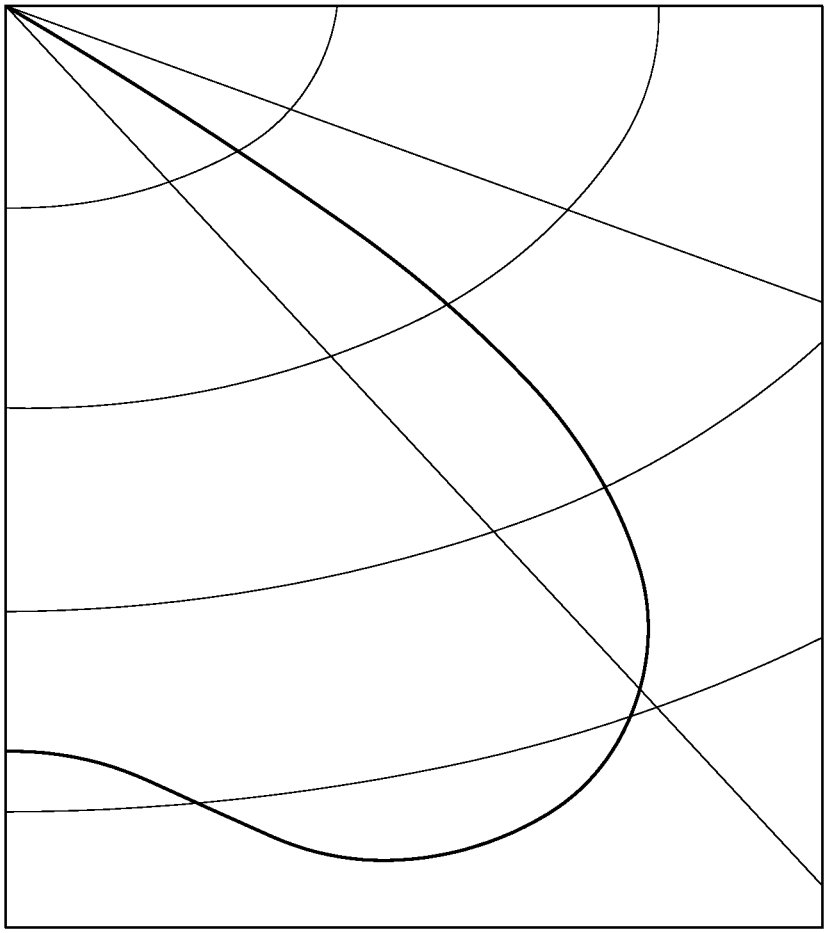

Beneath the optical assembly 50 is a retaining ring 60. The retaining ring 60 is formed of stamped aluminum and may be anodized to a specular finish. Alternatively, other materials and finishes may be utilized. The retaining ring 60 has a cylindrical shape with a retaining lip 62 therein. The retaining lip 62 provides a seat for the optical assembly 50 to be seated in the retaining ring. The retaining ring 62 also serves a secondary function of reflecting light from the lower surface, downward. This directs a higher amount of light downwardly, beneath the downlight 10 and increases the light output in this area of a light distribution graph, as shown in FIG. 10 and as compared to FIG. 1.

Figure 6:
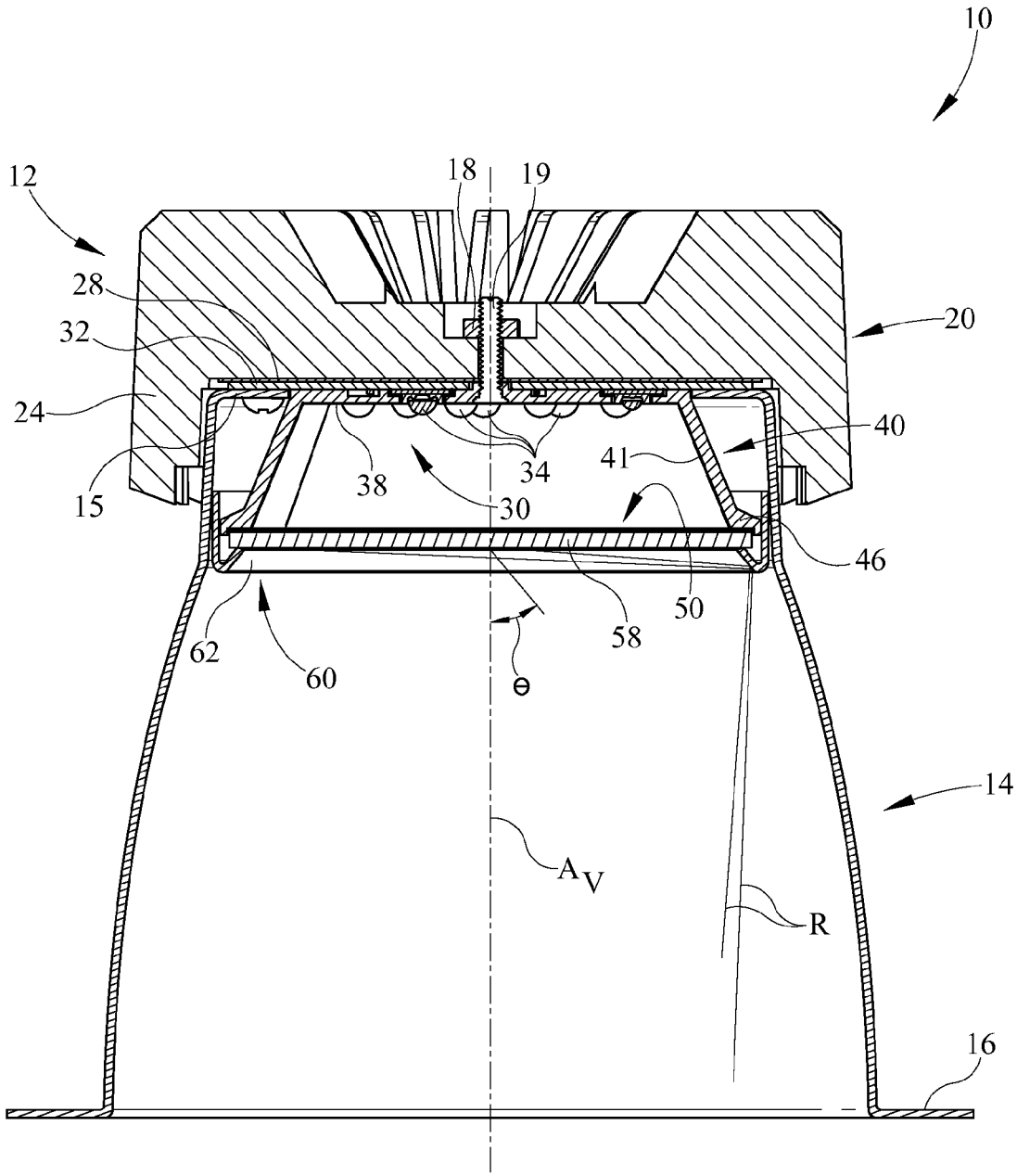
FIG. 6 is a side-sectional view of the LED downlight of FIG. 2, including ray-traces depicting the effect of the reflective surface of the retaining ring.

Referring now to FIG. 6, a cross-sectional view of the LED downlight is shown in the assembled configuration. The mixing subassembly 40 is positioned in the upper portion of the reflector 14. The retaining ring 60 includes a lip 62 which is disposed at an angle θ to a vertical axis $A_v$. The angle θ measured from the vertical axis $A_v$ may be between 35 and 65 degrees. More preferable, the angle θ is within the range of about 40° to 60°, and even more preferably the angle is in the range from about 44° to 51° degrees. The retaining lip 62 provides a position to seat the optical assembly 50 which comprises a glass lens and a diffuser having a phosphor film, according to the exemplary embodiment. The mixing chamber 40 is seated against the upper surface of the optical assembly 50. The optical assembly 50 rests against the retaining lip 62 and therefore the optical assembly 50 is captured between the retaining lip 62 and the lower flange 46 of the mixing chamber 40.

The lower surface of the retaining ring 62 also serves as a secondary reflector. Ray traces R are indicated reflecting from the inner surface of lip 62 downwardly which result in higher light distribution beneath the downlight 10. This is indicated graphically in FIG. 10. The reflective surface 62 directs light downwardly to increase illumination beneath the downlight at the center of a measured light distribution pattern. With this downward kick of light through a retaining ring 60 the LED downlight improves illumination in this central portion of a measurable light distribution.

FIG. 6 also depicts a fastener 19 extending upwardly through the mixing chamber 40 and through the heat sink 20. A subassembly nut 18 is disposed on the upper side of the heat sink 20 and fastens the mixing chamber 40, reflector 14 and heat dissipating subassembly 12 together. The upper shoulder 15 of the reflector 14 is sandwiched or captured between the heat sink 20, thermal interface 28 and LED printed circuit board assembly 30 on one side and the spacers 48 on the opposite side.

Figure 7:
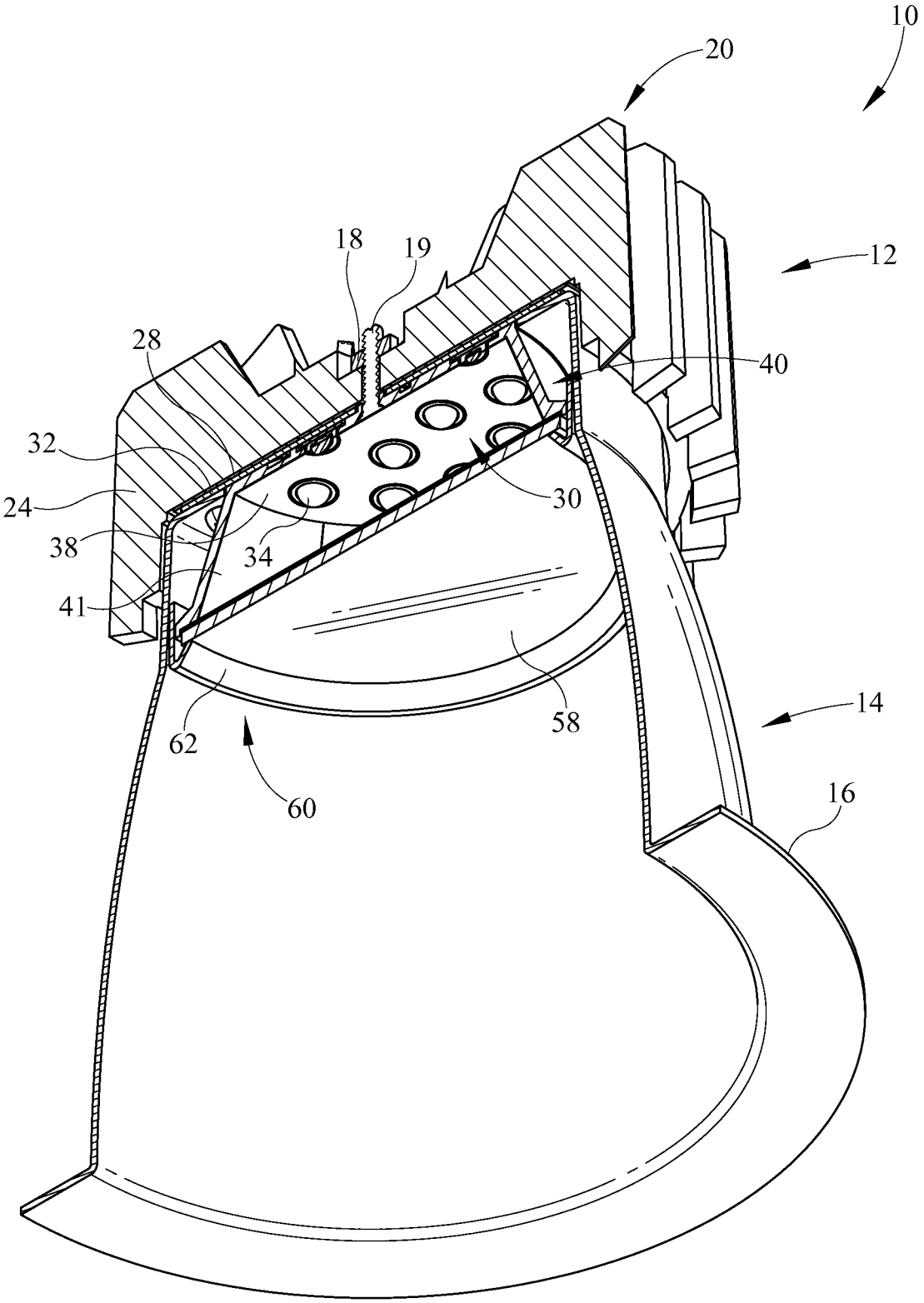
FIG. 7 is a sectioned perspective view of the LED downlight of FIG. 2.

Referring now to FIG. 7, a cross-sectional prospective view of the LED downlight is depicted. The section view shows the first heat dissipation subassembly 12 and the second heat dissipation subassembly or reflector 14. The first heat dissipation subassembly 12 the LED printed circuit board assembly 30 is positioned beneath the thermal pad or interface 28. On the opposite side of the thermal pad 28 is the heat sink 20. Thus, heat is transferred from the LED printed circuit board assembly 30 through the thermal interface 28 to the heat sink 20 in one direction. The heat sink 20 is positioned within a plenum area within the ceiling. As heat builds up within this plenum area, it becomes more difficult for the plenum area to dissipate the heat so that the LED downlight 10 can continue to run as efficiently as possible. However, beneath the plenum, the primary reflector 14 is able to conduct thermal energy to the space beneath the downlight which is typically of a cooler temperature than the air in the plenum above the downlight 10. Thus, in order to take advantage of the cooler air in the area beneath the ceiling, the LED downlight transfers thermal energy from the LED printed circuit board assembly 30 to the primary reflector 14. According to the instant embodiment, the metal core printed circuit board 32 is in direct contact with the primary reflector below to transfer energy from the circuit board 32 to the primary reflector 14. Thus, the first heat dissipation mean 12 dissipates heat to the space generally above the LED downlight 10 and the primary reflector or second heat dissipation means 14 conducts thermal energy to the cooler air generally below the LED downlight 10.

Figure 8:
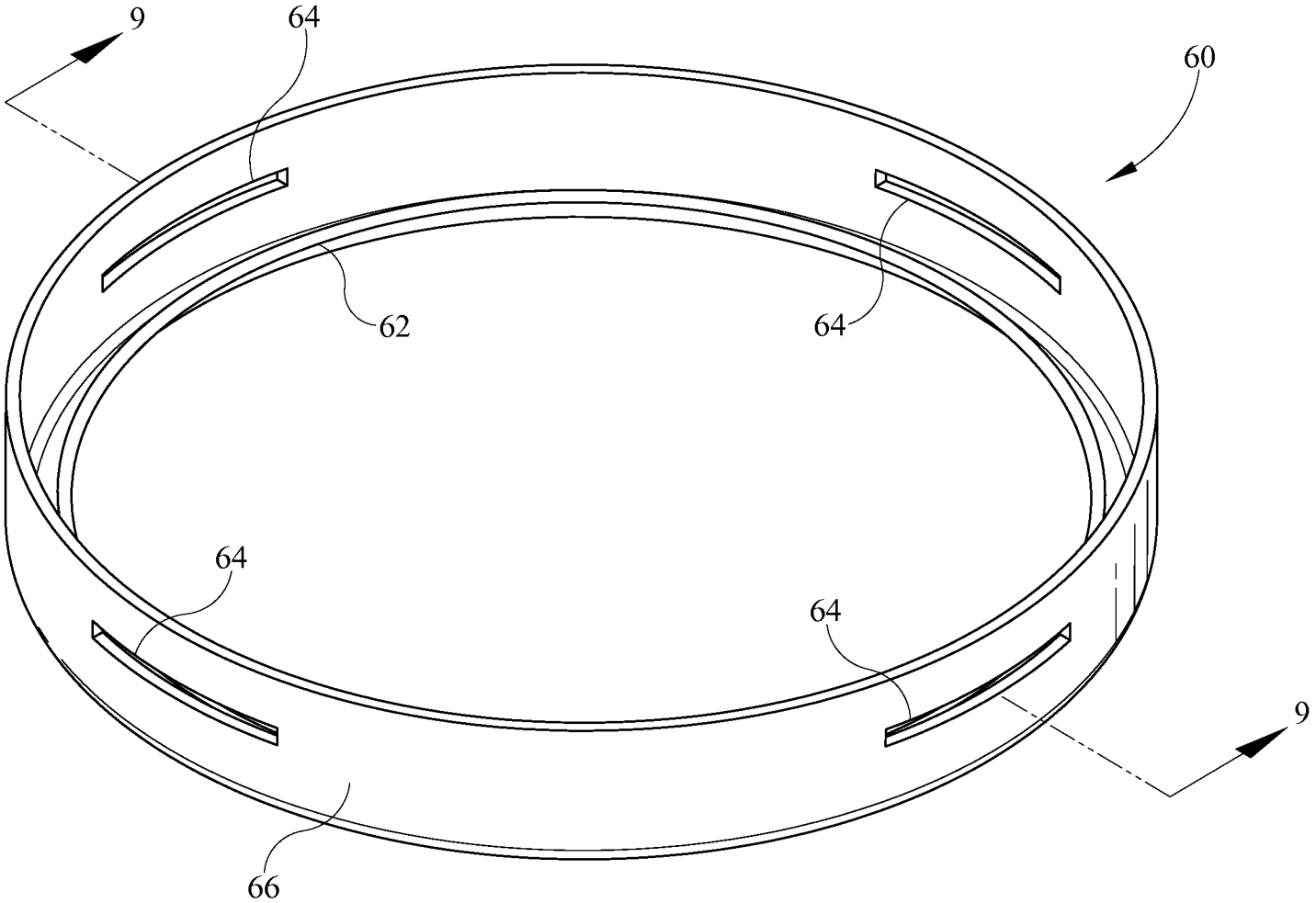
FIG. 8 is a perspective view of the reflective retaining ring.

Referring now to FIG. 8, the retaining ring 60 is depicted in perspective view. The retaining ring 60 is generally cylindrical in shape and has the lip 62 extending upwardly from a lower area of a retaining ring. Accordingly to the exemplary embodiment, the lower retaining lip 62 extends from the lower edge of the retaining ring 60. The sidewall 66 of the retaining ring comprises a plurality of slots 64. The slots receive the outer lower flange 46 (FIG. 5) of the mixing chamber 40. Once the flange 46 is positioned within the slot elements 64, the retaining ring 60 is bent to retain the mixing chamber 40 in place. Specifically, the upper portion of the retaining ring 62 above the slot 64 is bent radially inwardly at various positions so as to retain the mixing chamber 40 in position. However, other means of maintaining the assembly together may be utilized.

Figure 9:
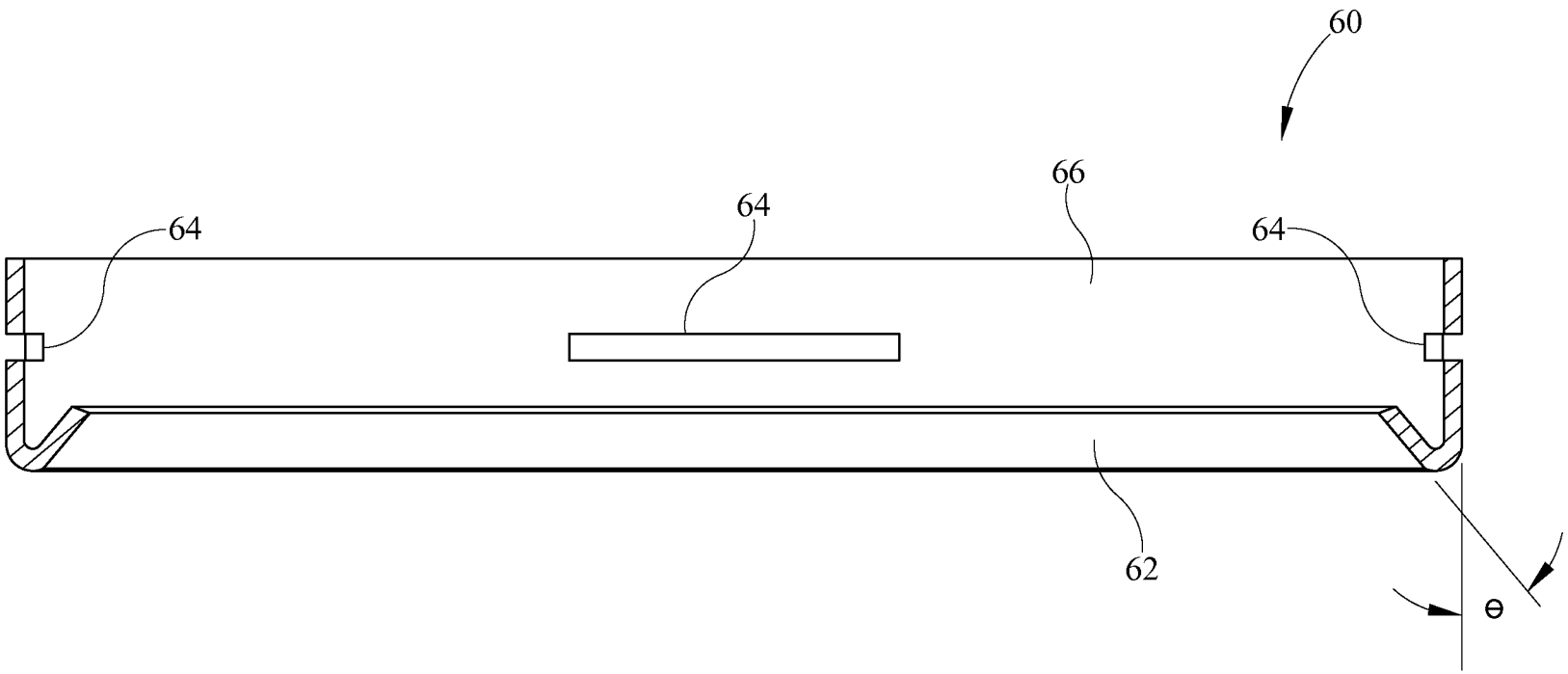
FIG. 9 is a sectional view of retaining ring as indicated in FIG. 8; and, FIG. 10 is a light distribution graph of the LED downlight of FIG. 2.

Referring to FIG. 9, the retaining ring 60 is shown in section view. The retaining lip 62 extends upwardly at an angle θ from the vertical. The slots 64 for retaining the flange 46 of the mixing chamber 40 are also shown.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An LED downlight, comprising:

a primary reflector having an upper end and an open lower end attachable to a ceiling;

an LED printed circuit board assembly disposed in said upper end of said primary reflector;

an optical assembly positioned beneath said LED printed circuit board assembly;

a secondary reflective ring for improving light distribution positioned beneath said LED printed circuit board assembly and within said primary reflector, said secondary reflector ring supporting said optical assembly on a mixing chamber disposed within said primary reflector.

2. The LED downlight of claim 1, said secondary reflector ring having an inner beveled surface.

3. The LED downlight of claim 2, said inner beveled surface directing light downwardly centrally beneath said downlight.

4. The LED downlight of claim 2, said inner beveled surface being at angle of between about 35 and 65 degrees.

5. The LED downlight of claim 1, said LED downlight having a plurality of blue LEDs.

6. The LED downlight of claim 5, said optical assembly having a phosphor system on an inner surface closest to said LED printed circuit board assembly.

7. An LED ceiling downlight, comprising:

an LED array disposed on a printed circuit board;

a mixing chamber disposed within a primary reflector, said LED array positioned near an upper end of said primary reflector;

a retaining ring having a reflective inner surface positioned within said primary reflector;

an optical assembly disposed within said retaining ring;

said mixing chamber capturing said optical assembly within said retaining ring;

said retaining ring inner surface being beveled and distributing a light pattern downward and centrally beneath said downlight.

8. The LED downlight of claim 7, said beveled inner surface disposed at an angle of between about 35 and 65 degrees.

9. The LED downlight of claim 7, said beveled inner surface having a length of about 0.1 inches.

10. The LED downlight of claim 7, said beveled inner surface extending from said lens to said primary reflector.

11. The LED downlight of claim 7, said retaining ring having a lip for seating said lens.

12. The LED downlight of claim 7, said LED array having a plurality of white LEDs.

13. The LED downlight of claim 7, said LED array connected to a metal core printed circuit board.

14. The LED downlight of claim 7, said retaining ring formed of aluminum.

15. The LED downlight of claim 7, said retaining ring inner beveled surface being one of specular, diffuse or semi-diffuse.

16. An LED downlight, comprising:

a primary reflector having an upper end and a lower open end attachable to a ceiling;

a LED printed circuit board assembly disposed near said upper end of said primary reflector;

a mixing subassembly depending downwardly toward a lens, said mixing subassembly receiving light from said LED printed circuit board assembly, said lens beneath said LED printed circuit board assembly;

a retaining ring receiving said lens, said retaining ring disposed within said primary reflector;

said retaining ring further comprising an angled inner reflective surface.

17. The LED downlight of claim 16 further comprising a plurality of LED apertures disposed in an upper surface of said mixing subassembly.

18. The LED downlight of claim 16, said mixing subassembly having a reflective inner surface.

19. The LED downlight of claim 16 said mixing subassembly being substantially frusto-conical in shape.

20. The LED downlight of claim 16 further comprising said mixing subassembly being seated in said retaining ring.

* * * * *